US012459699B2

(12) United States Patent
Shiotani et al.

(10) Patent No.: US 12,459,699 B2
(45) Date of Patent: Nov. 4, 2025

(54) CAN LID TAB AND CAN LID

(71) Applicant: DAIWA CAN COMPANY, Tokyo (JP)

(72) Inventors: Masahiro Shiotani, Sagamihara (JP); Rio Miyashita, Sagamihara (JP)

(73) Assignee: DAIWA CAN COMPANY, Tokyo (JP)

( * ) Notice: Subject to any disclaimer, the term of this patent is extended or adjusted under 35 U.S.C. 154(b) by 0 days.

(21) Appl. No.: 18/058,048

(22) Filed: Nov. 22, 2022

(65) Prior Publication Data

US 2023/0106536 A1 Apr. 6, 2023

Related U.S. Application Data

(63) Continuation of application No. PCT/JP2021/020029, filed on May 26, 2021.

(30) Foreign Application Priority Data

May 28, 2020 (JP) ..... 2020-092832

(51) Int. Cl.
*B65D 17/34* (2006.01)
*B65D 17/28* (2006.01)

(52) U.S. Cl.
CPC ..... *B65D 17/34* (2018.01); *B65D 17/4012* (2018.01)

(58) Field of Classification Search
CPC ..... B65D 17/34; B65D 17/4012
USPC ..... 220/269
See application file for complete search history.

(56) References Cited

U.S. PATENT DOCUMENTS 43,325 A * 6/1864 Merrill ..... C10G 19/00 208/284
182,247 A * 9/1876 Turley ..... C11D 13/02 510/463
3,327,891 A * 6/1967 Smyth ..... B65D 17/4012 220/269

(Continued)

FOREIGN PATENT DOCUMENTS

AU 2021317947 A1 * 3/2023 ..... B65D 17/02
EP 1964784 A1 9/2008

(Continued)

OTHER PUBLICATIONS

International Search Report dated Jul. 20, 2021 received in PCT/JP2021/020029.

(Continued)

*Primary Examiner* — Orlando E Aviles
*Assistant Examiner* — Niki M Eloshway
(74) *Attorney, Agent, or Firm* — Scully, Scott, Murphy & Presser, P.C.

(57) ABSTRACT

A can lid tab includes a flat plate-shaped attachment portion including a rivet hole to be attached to a rivet portion provided in a panel portion of a can lid, the attachment portion being in contact with the panel portion; a tip portion continuous with the attachment portion; and a finger hook portion formed on a side opposite to the tip portion across the attachment portion, at least an upper surface on a rear end side of the finger hook portion being inclined downward from the tip portion side toward the rear end side with respect to the attachment portion.

9 Claims, 4 Drawing Sheets

(56) References Cited

U.S. PATENT DOCUMENTS

| | | | | | |
|---|---|---|---|---|---|
| 3,938,696 | A * | 2/1976 | Herbst | B65D 79/008 | 220/273 |
| 4,015,744 | A * | 4/1977 | Brown | B65D 17/4012 | 220/269 |
| 4,148,410 | A * | 4/1979 | Brown | B65D 17/4012 | 220/269 |
| 4,150,765 | A * | 4/1979 | Mazurek | B65D 17/4012 | 220/269 |
| 4,383,621 | A | 5/1983 | Meneghin et al. | | |
| 4,784,284 | A * | 11/1988 | Miyauchi | B65D 17/4012 | 220/273 |
| 5,007,554 | A * | 4/1991 | Hannon | B65D 17/4012 | 220/269 |
| 5,653,355 | A * | 8/1997 | Tominaga | B65D 17/4012 | 220/272 |
| 7,891,519 | B2 * | 2/2011 | Matsukawa | B65D 17/404 | 220/272 |
| 7,942,285 | B2 * | 5/2011 | Hasegawa | B65D 17/4011 | 220/269 |
| 2010/0163560 | A1 * | 7/2010 | Leboucher | B65D 17/401 | 220/285 |
| 2012/0043325 | A1 * | 2/2012 | Williams | B65D 79/008 | 220/270 |
| 2017/0029194 | A1 * | 2/2017 | Dunn | B65D 79/008 | |
| 2023/0082001 | A1 * | 3/2023 | Shiotani | B65D 17/347 | 220/276 |
| 2023/0106536 | A1 * | 4/2023 | Shiotani | B65D 17/34 | 220/269 |
| 2023/0166884 | A1 * | 6/2023 | Shiotani | B65D 17/4012 | 220/270 |

FOREIGN PATENT DOCUMENTS

| | | | | | |
|---|---|---|---|---|---|
| JP | S51-40660 | U | | 3/1976 | |
| JP | S61-259952 | A | | 11/1986 | |
| JP | S62-105132 | U | | 7/1987 | |
| JP | H1-0182247 | A | | 7/1989 | |
| JP | H02-502814 | A | | 9/1990 | |
| JP | 2010-519147 | A | | 6/2010 | |
| JP | 2011126588 | A | * | 6/2011 | B65D 17/50 |
| JP | 2012131518 | A | * | 7/2012 | |
| JP | 2012-524699 | A | | 10/2012 | |
| JP | 2013189225 | A | * | 9/2013 | |
| JP | 2015085962 | A | * | 5/2015 | |
| JP | 6808327 | B2 | * | 1/2021 | |
| WO | 1989/002854 | A1 | | 4/1989 | |
| WO | WO-8902854 | A1 | * | 4/1989 | B21D 39/00 |
| WO | WO-2019208273 | A1 | * | 10/2019 | B21D 51/383 |
| WO | WO-2020017311 | A1 | * | 1/2020 | B65D 17/347 |
| WO | WO-2021241639 | A1 | * | 12/2021 | B65D 17/347 |
| WO | WO-2021241640 | A1 | * | 12/2021 | B65D 17/34 |
| WO | WO-2022025112 | A1 | * | 2/2022 | B65D 17/02 |
| WO | WO-2023095880 | A1 | * | 6/2023 | |
| WO | WO-2023095886 | A1 | * | 6/2023 | |

OTHER PUBLICATIONS

Japanese Office Action dated Oct. 31, 2023 received in 2020-092832.

Preliminary Report on Patentabiity dated Nov. 17, 2022 and Written Opinion of the International Searching Authority dated Jul. 20, 2021 received in PCT/JP2021/020029.

Extended European Search Report dated May 13, 2024 received in 21812009.5.

European Office Action dated Mar. 6, 2025 received in 21 812 009.5.

* cited by examiner

CAN LID TAB AND CAN LID

CROSS-REFERENCE TO RELATED APPLICATION

This application is a Continuation Application of PCT Application No. PCT/JP2021/020029, filed May 26, 2021 and based upon and claiming the benefit of priority from Japanese Patent Application No. 2020-092832, filed May 28, 2020, the entire contents of all of which are incorporated herein by reference.

FIELD

The present invention relates generally to a can lid tab and a can lid used for a can.

BACKGROUND

Conventionally, as can lids used for cans for food products, so-called full-open type can lids, which are opened on the entire surface, are widely used. In a can for a food product, after filling the can with contents, the final product is formed by retort treatment, and an internal pressure of the can becomes negative. However, as disclosed in Japanese Patent Application KOKAI Publication No. 2012-131518 and Japanese PCT National Publication No. H2-502814, it has been proposed in recent years to use a full-open type can lid even in a can having a positive internal pressure.

SUMMARY

In the case of a can in which the internal pressure is positive, a central portion of a can lid expands into a dome shape due to the internal pressure. At this time, an opening tab attached to a rivet portion formed on a periphery of a panel portion of the can lid is displaced so that a finger hook portion thereof is lifted upward. As a result, the finger hook portion of the tab may protrude above a seamed portion between the can lid and a can body. If the finger hook portion of the tab protrudes above the seamed portion between the can lid and the can body, there is a concern that the tab may be caught by another member during conveyance or the like of the can. In addition, when a purchaser takes the can displayed in a store with his/her hand, there is a concern that the hand may be caught by the tab. Therefore, there is a demand for a tab that can prevent the finger hook portion from protruding above the seamed portion so as to ensure sufficient conveyance performance, etc. even in the case of a positive pressure can.

According to one aspect of the embodiments, a can lid tab includes a flat plate-shaped attachment portion including a rivet hole to be attached to a rivet portion provided in a panel portion of a can lid, the attachment portion being in contact with the panel portion; a tip portion continuous with the attachment portion; and a finger hook portion formed on a side opposite to the tip portion across the attachment portion, at least an upper surface on a rear end side of the finger hook portion being inclined downward from the tip portion side toward the rear end side with respect to the attachment portion.

DETAILED DESCRIPTION

Hereinafter, a configuration of a can lid 1 having a tab 12 according to an embodiment of the present invention will be described with reference to FIGS. 1 to 6.

Figure 1:
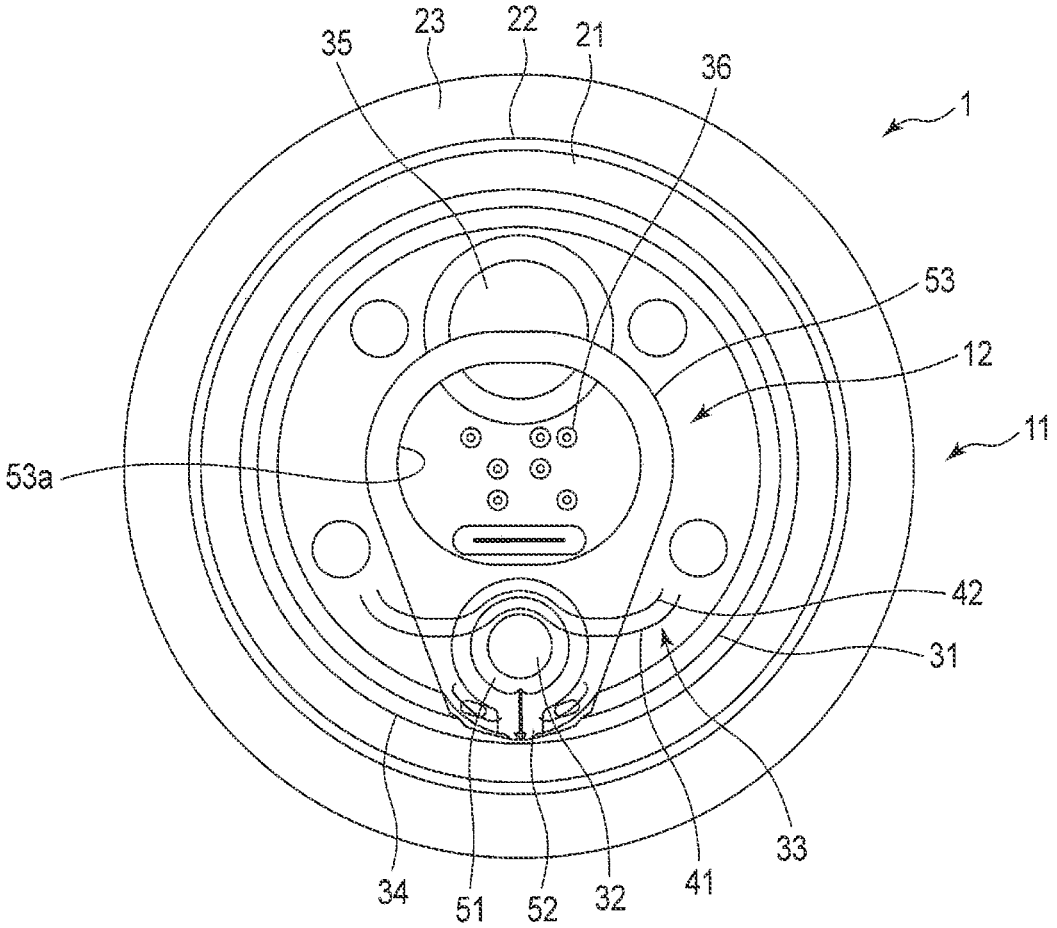
FIG. 1 is a plan view showing a configuration of a can lid according to an embodiment of the present invention.
Figure 2:
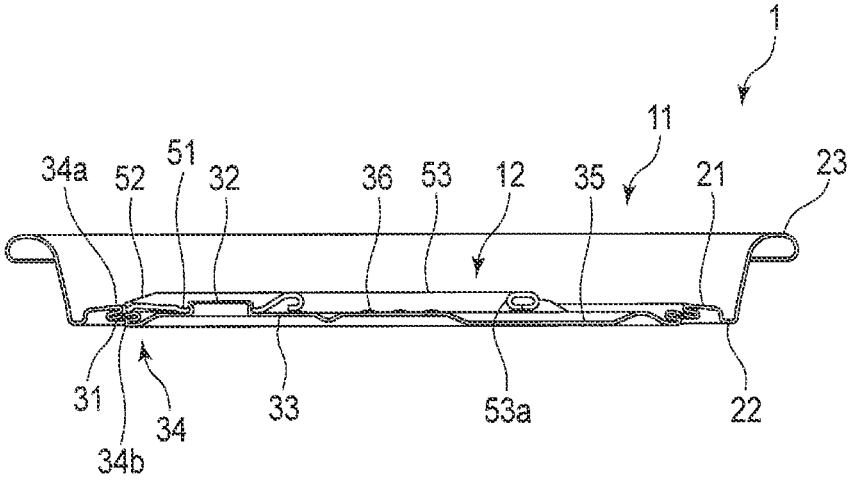
FIG. 2 is a cross-sectional view showing the configuration of the can lid.
Figure 3:
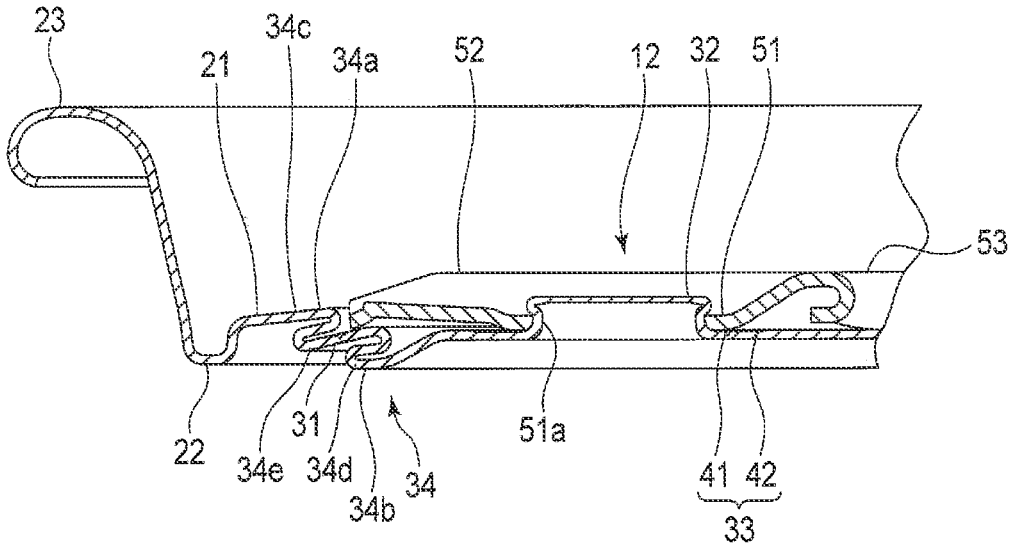
FIG. 3 is a cross-sectional view showing a configuration of an essential part of the can lid.
Figure 4:
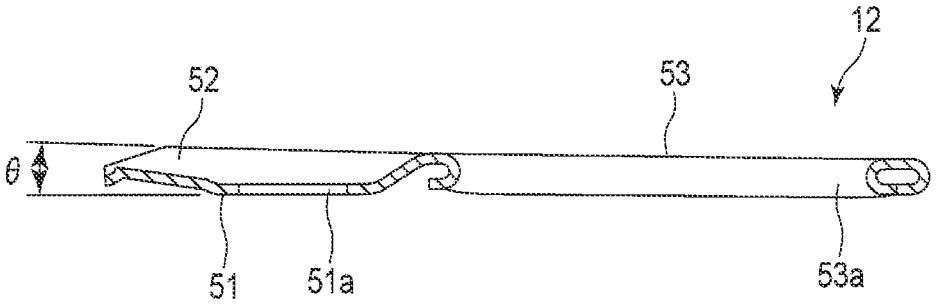
FIG. 4 is a cross-sectional view showing a configuration of a tab used for the can lid.
Figure 5:
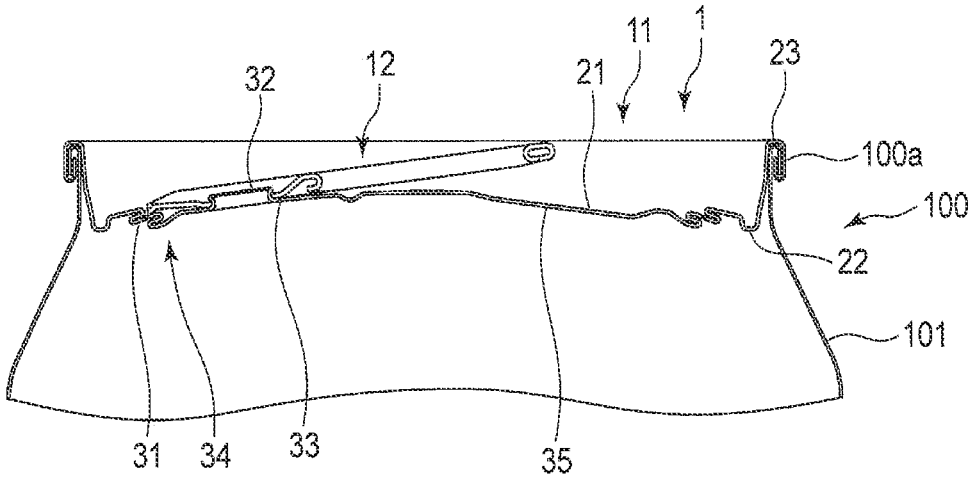
FIG. 5 is a cross-sectional view showing a configuration of an essential part of a can for which the can lid is used, and an example in which the can lid expands by an internal pressure.
Figure 6:
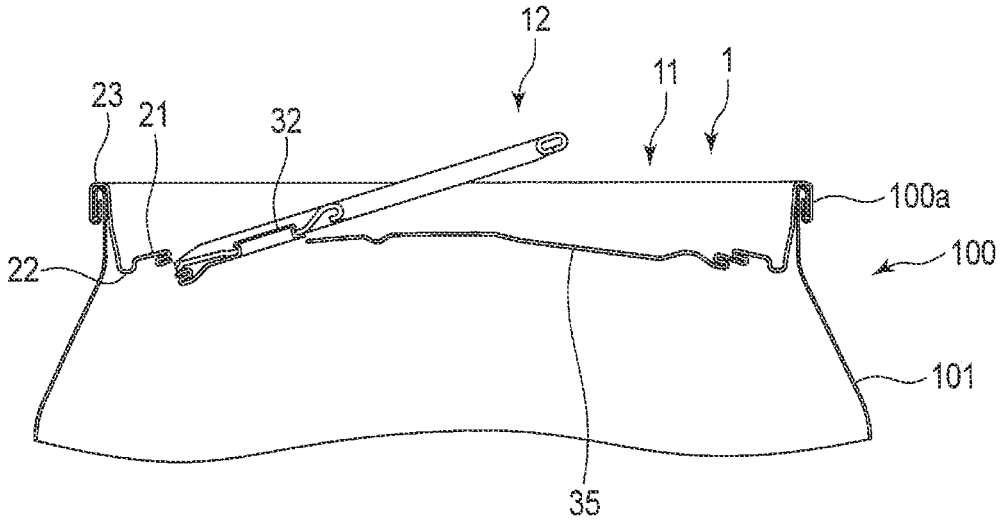
FIG. 6 is a cross-sectional view showing an example of a state when a tab is opened in the example in which the can lid expands by the internal pressure.

FIG. 1 is a plan view showing a configuration of the can lid 1 according to the embodiment of the present invention, and FIG. 2 is a cross-sectional view showing the configuration of the can lid 1. FIG. 3 is a cross-sectional view showing a configuration around a rivet portion 32 of the can lid 1, and FIG. 4 is a cross-sectional view showing a configuration of the tab 12. FIGS. 5 and 6 are cross-sectional views showing a configuration of a can 100 for which the can lid 1 is used and showing a state in which a panel portion 21 of the can lid 1 expands into a dome shape. FIG. 5 shows a configuration before an opening operation by the tab 12, and FIG. 6 shows a configuration at the time of the opening operation by the tab 12.

As shown in FIGS. 1, 2, 5, and 6, the can lid 1 is, for example, a so-called full-open type which is opened on the entire surface. As shown in FIGS. 5 and 6, the can lid 1 is a member of the can 100 in which, for example, a retort food, a beverage such as a carbonated beverage or an alcoholic beverage, or the like is held as a content, and constitutes an opening portion for dispensing the content from inside the can 100 to the outside. The can lid 1 is integrated with a can body 101 of the can 100 by seaming. As a result, in the can 100, the can lid 1 and the can body 101 are airtightly fixed by a seamed portion 100*a*.

The can 100 is, for example, a positive pressure can, the inside of which is under a positive pressure. The can 100 may be either a two-piece can or a three-piece can. The contents are not limited to beverages or food products, and may be something other than beverages and food products. That is, the contents considered applicable include a variety of things that can be sealed in the can 100.

As shown in FIGS. 1 and 2, the can lid 1 includes a can lid body 11 and the tab (can lid tab) 12. The can lid 1 is formed by pressing a metal plate to form the can lid body 11 and the tab 12 in another process, and then fixing the tab 12 to the panel portion 21. Examples of the metal plate forming the can lid body 11 include an aluminum alloy plate and a surface-treated steel plate having a resin film formed on the surface thereof. Examples of the metal plate forming the tab 12 include an aluminum alloy plate.

As shown in FIGS. 1 to 3, 5, and 6, the can lid body 11 includes the panel portion 21, a ring-shaped groove portion 22 provided on an outer peripheral edge of the panel portion 21, and a flange portion 23 provided on an outer peripheral edge of the ring-shaped groove portion 22.

As shown in FIGS. 1 to 3, the panel portion 21 is formed in a disk shape. The panel portion 21 includes a score line 31, a rivet portion 32, an auxiliary score line 33, a protection portion 34, and a finger insertion concave portion 35. The panel portion 21 may also have a display portion 36 or the like such as braille for displaying the content of the can 100. Further, the panel portion 21 may have a convex portion or a concave portion for product identification, design, reinforcement, or the like.

As shown in FIG. 6, the score line 31 is broken by the opening operation of the tab 12. By being broken, the score line 31 creates an opening portion of the can lid 1 in the panel portion 21. In other words, the score line 31 surrounds a region which becomes an opening piece when the opening portion of the can lid 1 is formed. Since the can lid 1 in the present embodiment is a full-open type, the score line 31 is formed in a circular shape or an approximately circular shape as shown in FIG. 1, for example. When the score line 31 is broken, as shown in FIG. 6, a portion of the panel portion 21 that is on an inner side of the score line 31 in a radial direction can be removed as an opening piece together with the rivet portion 32 from a portion of the panel portion 21 that is on an outer side of the score line 31 in the radial direction.

The score line 31 is a groove that constitutes a fragile part that enables a part of the panel portion 21 to be broken in the shape of the opening portion by an external force. As shown in FIG. 3, the score line 31 is, for example, a wedge-shaped groove provided on an outer surface of the panel portion 21, and a part of the panel portion 21 is formed to be thin by the score line 31. Here, the outer surface of the panel portion 21 is a main surface exposed to the outside in a state where the can body 101 of the can 100 is provided with the can lid 1, that is, a surface constituting an upper surface of the can 100.

The score line 31 is, for example, arranged in the protection portion 34. The score line 31 is not limited to a circular shape, and may have, for example, a configuration in which the score line 31 is formed in a partially intermittent arc shape, most of the panel portion 21 is opened, and an opening piece that is opened is partially continuous with the panel portion 21.

As shown in FIGS. 1 to 3, 5, and 6, the rivet portion 32 is provided on one main surface of the panel portion 21, specifically, on the outer surface of the panel portion 21. The rivet portion 32 is provided on the outer peripheral edge side of the panel portion 21 and on the center side with respect to the score line 31. That is, the rivet portion 32 is provided adjacent to the inner side of the score line 31 in the radial direction.

The rivet portion 32 is formed in a columnar shape in such a manner as to project from one main surface of the panel portion 21. The rivet portion 32 is formed by drawing a part of the panel portion 21 into a cylindrical shape. By swaging the rivet portion 32 after the tab 12 is arranged, the tab 12 is fixed to the panel portion 21. In FIGS. 1 to 3, 5, and 6, the rivet portion 32 is shown in a state after swaging.

As shown in FIGS. 1 to 3, the auxiliary score line 33 is formed in the vicinity of the rivet portion 32 of the panel portion 21. A part of the auxiliary score line 33 is broken at the time of the opening operation of the tab 12. The auxiliary score line 33 includes, for example, a main score line 41 and a sub score line 42 which is provided in parallel to the main score line 41 and on a side opposite to the rivet portion 32 across the main score line 41.

The main score line 41 is a groove that constitutes a fragile part that enables a part of the panel portion 21 to be broken in the shape of the opening portion by an external force. The main score line 41 is, for example, a wedge-shaped groove provided on the outer surface of the panel portion 21. A part of the panel portion 21 is formed thin by the main score line 41. As shown in FIG. 6, the main score line 41 is broken at the time of the opening operation of the tab 12 to allow the rivet portion 32 to move upward.

The sub score line 42 is provided on an inner side of the main score line 41 in the radial direction. The sub score line 42 is formed in parallel to the main score line 41. The sub score line 42 is, for example, a wedge-shaped groove provided on the outer surface of the panel portion 21. The sub score line 42 is formed to have a depth smaller than that of the main score line 41. That is, a thickness of a portion of the panel portion 21 where the sub score line 42 is provided is formed thicker than a thickness of a portion of the panel portion 21 where the main score line 41 is provided. A part of the panel portion 21 is formed thin by the sub score line 42.

As shown in FIGS. 2, 3, 5, and 6, the protection portion 34 is formed by the panel portion 21 being folded in a ring shape. The protection portion 34 is, for example, formed by being folded four times on an inner side of the outer peripheral edge of the panel portion 21 in the radial direction and on an outer side of the rivet portion 32 in the radial direction. That is, the protection portion 34 is formed by arranging the panel portion 21 in five layers. The score line 31 is formed in the protection portion 34 and in the third layer of the panel portion 21.

When the tab 12 is opened and the score line 31 is broken, the protection portion 34 constitutes an outer protection portion 34*a* that protects an inner peripheral edge of a portion of the panel portion 21 broken along the score line 31 that is present in the can body 101, and an inner protection portion protects an outer peripheral edge of a portion (opening piece) of the panel portion 21 broken along the score line 31 that is removed from the can body 101. The outer protection portion 34*a* is constituted by a three-layered panel portion 21, and a folded portion is present at the inner peripheral edge of the opened panel portion 21. The inner protection portion 34*b* is constituted by a three-layered panel portion 21, and a folded portion is present at the outer peripheral edge of the portion separated from the opening of the panel portion 21.

In other words, as shown in FIG. 3, the protection portion 34 has an upper layer 34*c* formed by the folded panel portion 21 in the first and second layers and located on an outer surface side of the can lid 1, a lower layer 34*d* formed by the folded panel portion 21 in the fourth and fifth layers and located on an inner surface side of the can lid 1, and an intermediate layer 34*e* formed by the folded panel portion 21 in the third layer and located between the upper layer 34*c* and the lower layer 34*d*. The outer protection portion 34*a* is formed by the upper layer 34*c* and a part of the intermediate layer 34*e*, and the upper layer 34*c* is located above the score line 31 and functions as a protection portion after the score line 31 is broken. The inner protection portion 34*b* is formed by a part of the intermediate layer 34*e* and the lower layer 34*d*, and the lower layer 34*d* is located below the score line 31 and functions as a protection portion after the score line 31 is broken.

The finger insertion concave portion 35 is located below a rear end of the tab 12 on which a finger is hooked, and is recessed from the outer surface of the panel portion 21.

The groove portion 22 is a ring-shaped recess which is provided continuously with the outer peripheral edge of the panel portion 21 and projects to a can body side when the panel portion 21 is fixed to the can body. The groove portion 22 has a function to improve the pressure resistance of the can lid 1.

The flange portion 23 is seamed with an opening end of the can body 101. The flange portion 23 is provided with a sealing resin layer on a surface contacting the can body 101.

As shown in FIGS. 1 to 4, the tab 12 includes an attachment portion 51, a tip portion 52, and a finger hook portion 53. In the tab 12, the attachment portion 51, the tip portion 52, and the finger hook portion 53 are formed integrally. When the tab 12 is opened by a finger or the like hooked on the finger hook portion 53, the tip portion 52 presses a portion of the panel portion 21 that is adjacent to the inner side of the score line 31 in the radial direction to break the score line 31.

As shown in FIGS. 3 and 4, the attachment portion 51 is formed in a flat plate shape, and has a rivet hole 51*a*. The attachment portion 51 is continuous with the tip portion 52 and the finger hook portion 53. The rivet hole 51*a* is formed to have an inside diameter into which the rivet portion 32 can be inserted. The rivet portion 32 inserted into the rivet hole 51*a* is swaged so that the attachment portion 51 is fixed to the panel portion 21 by the rivet portion 32.

The tip portion 52 is formed on a tip side of the tab 12. The tip portion 52 has a tip formed in an arc shape or a polygonal shape. The tip portion 52 is formed by, for example, bending double an outer peripheral edge excluding the tip.

The finger hook portion 53 is a portion on which a finger is hooked in order to lift the tab 12 at the time of the opening operation of the tab 12. As shown in FIGS. 1 and 2, for example, the finger hook portion 53 includes a ring hole 53*a* and is formed in a ring shape. As a specific example, the finger hook portion 53 is formed in a rectangular frame shape having arc-shaped corner portions. The finger hook portion 53 is formed on a side opposite to the tip portion 52 across the attachment portion 51. When the tab 12 is attached to the panel portion 21, a rear end of the finger hook portion 53 faces the finger insertion concave portion 35. The finger hook portion 53 is formed by, for example, bending an outer peripheral edge and an inner peripheral edge of the ring hole 53*a* so that they are doubled.

In such a tab 12, as shown in FIG. 4, at least an upper surface of the rear end side of the finger hook portion 53 is inclined downward from the tip portion 52 side toward the rear end side of the finger hook portion 53 with respect to the attachment portion 51. As a specific example, as shown in FIG. 4, the tab 12 is gradually inclined from the rivet hole 51*a* side of the tip portion 52 to the rear end of the finger hook portion 53 toward the panel portion 21 side with respect to a main surface of the attachment portion 51 that abuts against the panel portion 21. As a result, an upper surface of the tab 12 is inclined from the rivet hole 51*a* side of the tip portion 52 to the rear end of the finger hook portion 53 with respect to the main surface of the attachment portion 51 that abuts against the panel portion 21. Note that an inclination angle θ of the upper surface of the tab 12 shown in FIG. 4 with respect to the main surface of the attachment portion 51 that abuts against the panel portion 21 is set within a range of 0.5° to 10°, for example. In addition, the upper surface of the tab 12 is, in a longitudinal-sectional shape thereof, linearly formed from the rivet hole 51*a* side of the tip portion 52 to the tip of the finger hook portion 53.

According to the can lid 1 formed as described above, as shown in FIG. 5, it is possible to prevent the rear end of the finger hook portion 53 of the tab 12 from protruding from the seamed portion 100*a* of the can 100. To be more specific about this effect, as shown in FIGS. 5 and 6, if the can 100 is a positive pressure can, there is a concern that the central portion of the can lid 1 may expand into a dome shape due to the internal pressure of the can 100. If the central portion of the can lid 1 expands into a dome shape so as to protrude, since the rivet portion 32 is provided on the outer peripheral edge side of the panel portion 21, a portion of the panel portion 21 where the rivet portion 32 is provided is inclined toward the center of the can lid 1. Thus, due to the expansion of the panel portion 21 and the inclination of the tab 12, the finger hook portion 53 of the tab 12 is displaced upward, and a displacement amount thereof becomes larger toward the center of the can lid 1, and the displacement amount becomes largest at the rear end of the tab 12.

However, since the upper surface of the tab 12 is formed such that the finger hook portion 53 side is inclined toward the can body 101 side (downward), the finger hook portion 53 of the tab 12 is displaced in a downward direction in a state where the tab 12 is fixed to the panel portion 21. Thus, in the can lid 1, when the can lid 1 expands into a dome shape, a height position of the rear end of the tab 12 is closer to the panel portion 21 side than a height position of a rear end of a conventional tab in which the upper surface of the tab 12 is not inclined.

Therefore, even when the can lid 1 expands into a dome shape due to the internal pressure of the can 100, the tab 12 is less likely to protrude above the seamed portion 100*a*. For this reason, it is possible to prevent the tab 12 from being erroneously operated at the time of conveyance, etc. due to the tab 12 protruding above the seamed portion 100*a*, and it is possible to improve the conveyance performance of the can 100.

As described above, according to the tab 12 and the can lid 1 using the tab 12 according to one embodiment of the present invention, even if the can 100 to be used is a positive pressure can, the finger hook portion 53 can be prevented from protruding above the seamed portion 100*a*.

Note that the present invention is not limited to the embodiment described above. For example, in the above-described example, the tab 12 is inclined downward (toward the panel portion 21 side) with respect to the main surface of the attachment portion 51 on the panel portion 21 side from the attachment portion 51 side of the tip portion 52 to the rear end of the attachment portion 51. However, the present invention is not limited thereto. That is, at least the upper surface on the rear end side of the tab 12 may be inclined downward with respect to the main surface on the panel portion 21 side. For example, the upper surface of the finger hook portion 53 or only the upper surface on the rear end side of the finger hook portion 53 may be inclined downward.

Further, for example, the tab 12 may have a configuration in which at least the upper surface of the finger hook portion 53 is inclined downward with respect to the main surface of the attachment portion 51 on the panel portion 21 side, and at least the rear end side of the finger hook portion 53 is thinner than other parts. For example, the configuration in which at least the rear end of the finger hook portion 53 is thinned is formed by forming one of the upper surface and the lower surface of the finger hook portion 53 in a recessed shape.

Figure 7:
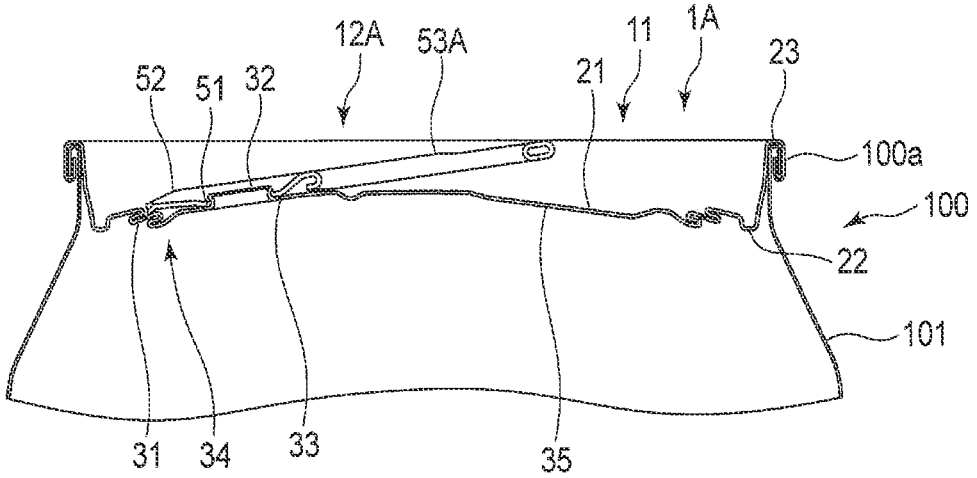
FIG. 7 is a cross-sectional view showing a configuration of a can lid using a tab according to another embodiment.

For example, as shown in FIG. 7, a can lid 1A of another embodiment may have a configuration in which an upper surface on a rear end side of a finger hook portion 53A of a tab 12A is recessed in a flat shape or an inclined shape so that the rear end side of the finger hook portion 53A is formed to be thin. In the example shown in FIG. 7, the upper surface on the rear end side of the finger hook portion 53A of the tab 12A is recessed in a flat shape.

Since the upper surface on the rear end side of the finger hook portion 53A of the tab 12A is recessed as described above, a height position of the rear end of the tab 12A can be set to be low if the can lid 1A expands into a dome shape. The upper surface on the rear end side of the finger hook portion 53A of the tab 12A may be recessed so as to be further inclined.

Figure 8:
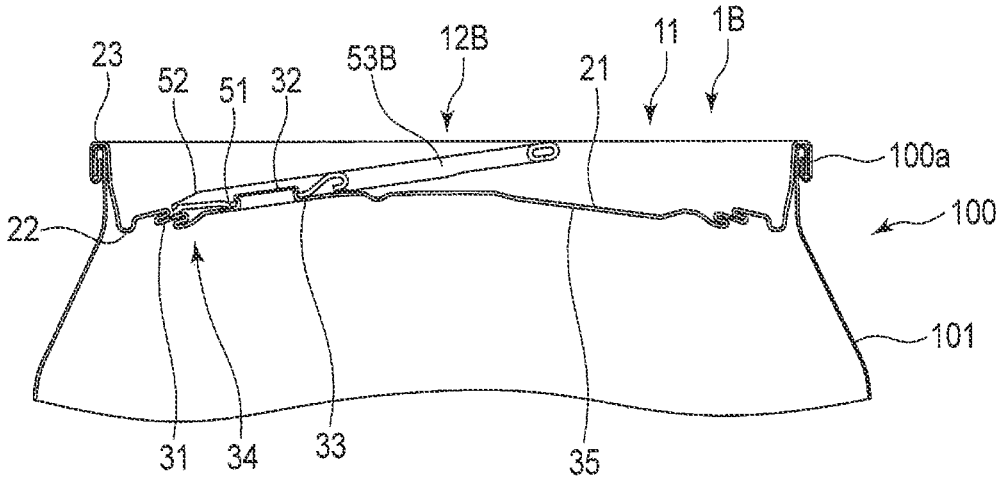
FIG. 8 is a cross-sectional view showing a configuration of a tab according to another embodiment.

Alternatively, for example, as shown in FIG. 8, a can lid 1B of another embodiment may have a configuration in which a lower surface on a rear end side of a finger hook portion 53B of a tab 12B is recessed in a flat shape or an inclined shape so as to be formed thin. In the example shown in FIG. 8, the lower surface on the rear end side of the finger hook portion 53B of the tab 12B is recessed in a flat shape.

By recessing the lower surface of the finger hook portion 53B of the tab 12B as described above, when the tab 12B is attached to the panel portion 21, a position of the rear end of the finger hook portion 53B of the tab 12B with respect to the panel portion 21 is closer to the panel portion 21 than the position of the rear end of the finger hook portion 53 of the tab 12 whose lower surface is not recessed with respect to the panel portion 21. When the panel portion 21 does not expand, a height position of the rear end of the finger hook portion 53B of the tab 12B with respect to the panel portion 21 can be lowered. Thus, if the can lid 1B expands into a dome shape, the height position of the rear end of the tab 12B can be lowered.

In the configuration in which the recess is provided in the upper surface or the lower surface of the finger hook portion of the tab, the recess can be formed in the finger hook portion 53A or 53B by crushing the upper surface or the lower surface of the finger hook portion 53A or 53B of the tab 12A or 12B at the time of forming the tab 12A or 12B.

The present invention is not limited to the above-described embodiments, and can be modified in practice without departing from the spirit of the invention. The embodiments may also be implemented by combining them appropriately, in which case the combined advantages are obtained. Furthermore, the embodiments include various inventions, and such various inventions can be derived by properly combining the structural elements disclosed in connection with the embodiments. For example, even if some structural elements are deleted from all the structural elements shown in the embodiments, when the problem can be solved and the advantageous effects can be obtained, such a configuration in which those structural elements are deleted can be extracted as an invention.

REFERENCE SIGNS LIST

1, 1A, and 1B: can lid, 11: can lid body, 12, 12A, and 12B: tab (can lid tab), 21: panel portion, 22: groove portion, 23: flange portion, 31: score line, 32: rivet portion, 33: auxiliary score line, 34: protection portion, 34*a*: outer protection portion, 34*b*: inner protection portion, 34*c*: upper layer, 34*d*: lower layer, 34*e*: intermediate layer, 35: finger insertion concave portion, 36: display portion, 41: main score line, 42: sub score line, 51: attachment portion, 51*a*: rivet hole, 52: tip portion, 53, 53A, and 53B: finger hook portion, 53*a*: ring hole, 100: can, 100*a*: seamed portion, 101: can body.

What is claimed is:

1. A can lid tab for use with a positive pressure can, the can lid tab comprising:

an attachment portion having a lower surface having a planar shape extending in a first plane, the attachment portion including a rivet hole configured to be attached to a rivet portion provided in a panel portion of a can lid, the attachment portion being configured to be in contact with the panel portion;

a tip portion extending continuously from the attachment portion in a first direction and terminating at a first end; and a finger hook portion continuously extending from the attachment portion and terminating at a second end, the finger hook portion extending from the attachment portion in a second direction opposite to the first direction;

wherein an upper surface of the tip portion and an upper surface of the finger hook portion, from a first position adjacent to the first end of the tip portion to a second position adjacent to the second end of the finger hook portion, are inclined relative to the first plane of the attachment portion;

the finger hook portion having a thin portion that is thinner in a direction from the lower surface toward the upper surface of the finger hook portion than other portions of the finger hook portion, the thin portion extending in the second direction from the second position to the second end of the finger hook portion; and the thin portion is formed by recessing of the upper surface of the finger hook portion in one of a flat shape or an inclined shape.

2. The can lid tab according to claim 1, wherein the upper surfaces extend continuously in a second plane from the first position to the second position, the second plane being inclined relative to the first plane.

3. The can lid tab according to claim 2, wherein the upper surface of the tip portion, from the first position to the first end, extends inclined in a third plane at an angle opposite to an angle of the second plane.

4. The can lid tab according to claim 1, wherein a lower surface of the finger hook portion extends from the attachment portion to the second end in the first plane.

5. A can lid for use with a positive pressure can, the can lid comprising:

a panel portion including a rivet portion; and a tab comprising:

an attachment portion having a lower surface having a planar shape extending in a first plane, the attachment portion including a rivet hole attached to the rivet portion, the attachment portion being in contact with the panel portion, a tip portion extending continuously from the attachment portion in a first direction and terminating at a first end, and a finger hook portion continuously extending from the attachment portion and terminating at a second end, the finger hook portion extending from the attachment portion in a second direction opposite to the first direction;

wherein an upper surface of the tip portion and an upper surface of the finger hook portion, from a first position adjacent to the first end of the tip portion to a second position adjacent to the second end of the finger hook portion, are inclined relative to the first plane of the attachment portion;

the finger hook portion having a thin portion that is thinner in a direction from the lower surface toward the upper surface of the finger hook portion than other portions of the finger hook portion, the thin portion extending in the second direction from the second position to the second end of the finger hook portion; and the thin portion is formed by recessing of the upper surface of the finger hook portion in one of a flat shape or an inclined shape.

6. The can lid according to claim 5, wherein the rivet portion is provided on an outer peripheral edge side of the panel portion.

7. The can lid according to claim 5, wherein the upper surfaces extend continuously in a second plane from the first position to the second position, the second plane being inclined relative to the first plane.

8. The can lid according to claim 7, wherein the upper surface of the tip portion, from the first position to the first end, extends inclined in a third plane at an angle opposite to an angle of the second plane.

9. The can lid according to claim 5, wherein a lower surface of the finger hook portion extends from the attachment portion to the second end in the first plane.

* * * * *